United States Patent [19]

Saunders

[11] Patent Number: 4,804,106

[45] Date of Patent: Feb. 14, 1989

[54] MEASURES TO CONTROL OPENING OF FULL-PANEL SAFETY-EDGE, CONVENIENCE-FEATURE END CLOSURES

[75] Inventor: William T. Saunders, Weirton, W. Va.

[73] Assignee: Weirton Steel Corporation, Weirton, W. Va.

[21] Appl. No.: 147,267

[22] Filed: Jan. 22, 1988

Related U.S. Application Data

[63] Continuation-in-part of PCT US87/03418, Dec. 23, 1987, published as WO88/05407, which is a continuation-in-part of PCT US87/02649, Sep. 29, 1987, published as WO88/05406, which is a continuation-in-part of PCT US87/00102, published Jan. 23, 1987, published as WO88/05405

[51] Int. Cl.[4] ..... B65D 17/34

[52] U.S. Cl. ..... 220/273

[58] Field of Search ..... 220/270–273

[56] References Cited

U.S. PATENT DOCUMENTS

| | | | |
|---|---|---|---|
| 4,116,360 | 9/1978 | McKernan et al. | 220/273 |
| 4,116,361 | 9/1978 | Stargell | 220/273 |
| 4,182,460 | 1/1980 | Holk, Jr. et al. | 220/271 |
| 4,406,378 | 9/1983 | Zysset | 220/273 |

*Primary Examiner*—George T. Hall

*Attorney, Agent, or Firm*—Raymond N. Baker

[57] ABSTRACT

A full-open, disc-removal, convenience-feature end wall closure with raw edge metal protection and improved easy-open features includes a peripherally-located scoreline defining the disc to be removed, a back scoreline located within the disc and a longitudinally rigid (non-lanced) opener made integral with the disc by a rivet. A multi-layer fold of sheet metal contiguous to the peripheral scoreline shields residual scoreline metal which remains with the disc. The back scoreline includes a central vent portion and a pair of legs extending, one each from such central portion, on opposite sides of the rivet, toward the adjacent portion of the peripheral scoreline so that, after rupture of the vent portion of the back scoreline, rupture of the back scoreline legs tends to move the opener in a radial direction; radially-directed movement is controlled and the working end of the opener is turned inwardly, in relation to a container, and toward a prescribed location with respect to the peripheral scoreline so as to facilitate initial rupture. The remainder of the peripheral scoreline is severed by continuing arcuate movement of the handle end of the opener which places the handle end radially outboard of the container for lever action opening using the chime seam as a fulcrum.

7 Claims, 6 Drawing Sheets

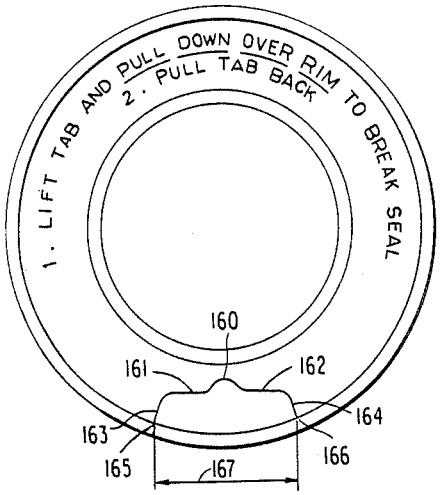
FIG.18
FIG.19
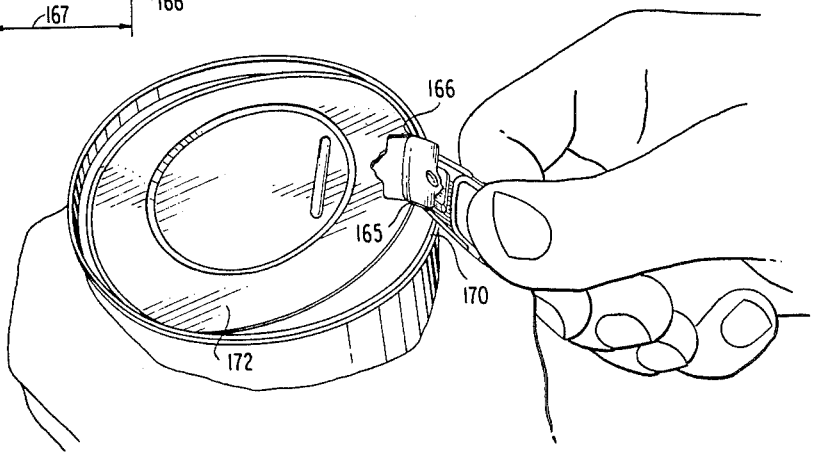
FIG.20
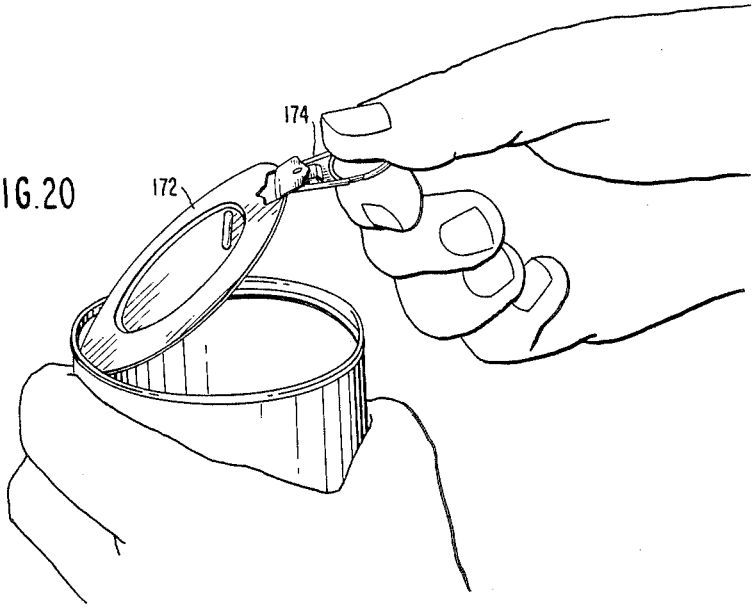

MEASURES TO CONTROL OPENING OF FULL-PANEL SAFETY-EDGE, CONVENIENCE-FEATURE END CLOSURES

This application is a continuation-in-part and claims priority of International Application Ser. No. PCT/US87/03418, filed Dec. 23, 1987 which was a continuation-in-part and claimed priority of International Application Ser. No. PCT/US87/02649, filed Sept. 29, 1987 which was a continuation-in-part and claimed priority of International application Ser. No. PCT/US87/00102, filed Jan. 23, 1987.

This invention is concerned with more accurately controlling opening of full-panel, safety-edge, convenience-feature end closures and includes methods, apparatus and structures to facilitate such objective.

Developmental work, not yet published or otherwise generally accessible, is concerned with use of steel easy-open ends on container packs by providing a full-panel, convenience-feature end closure made from steel which can be readily opened while also providing raw edge metal protection for the consumer after opening.

In such development work, it has been found that the special structural features of an end closure, or an associated can structure, required to provide such raw edge metal protection substantially rules out, for practical purposes, various measures used in the prior "disc-pull-out" easy-opener container art. In addition, such safety-edge structural features require special and more precise orientation of parts to provide for ease of opening.

The problems overcome by, and the contributions of, the present teachings are considered in more detail in relation to the accompanying drawings.

In such drawings:

FIGS. 6–11 are radial, cross-sectional, partial views of tooling and end closure structure for purposes of describing sequential fabrication steps of the embodiment of FIG. 2 in which:

FIG. 6 shows a blank forming stage,

FIG. 7 shows initial formation of a shallow depth rivet button,

Figure 5:
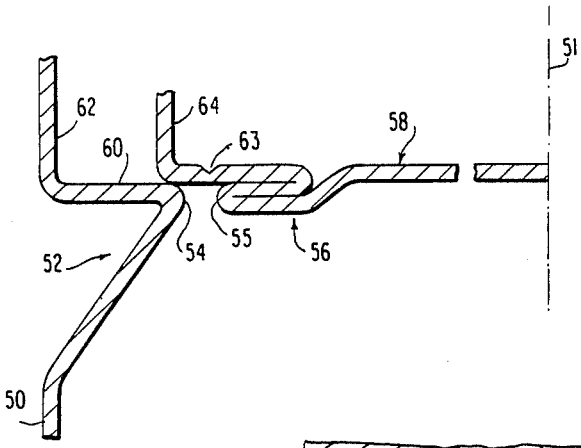
FIG. 5 is a radial cross sectional view of another embodiment of the invention.
Figure 8:
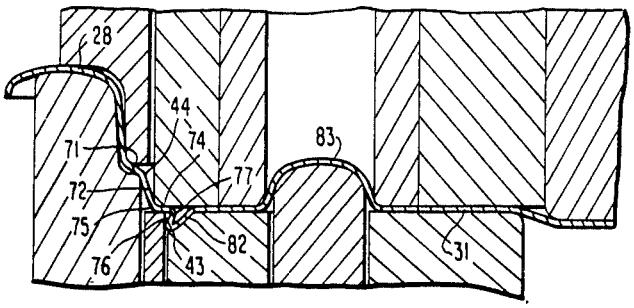
Figure 9:
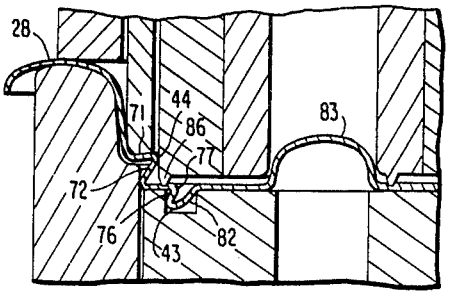
Figure 10:
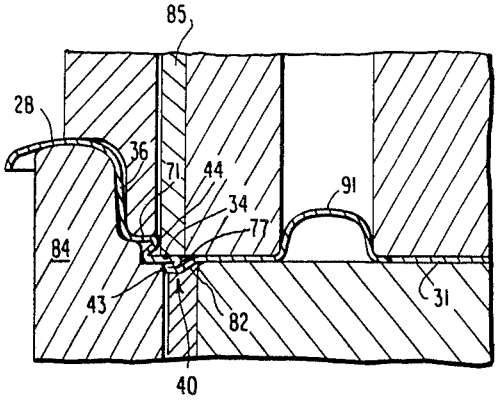
Figure 11:
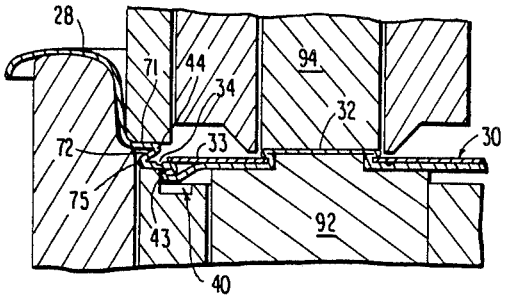
Figure 12:
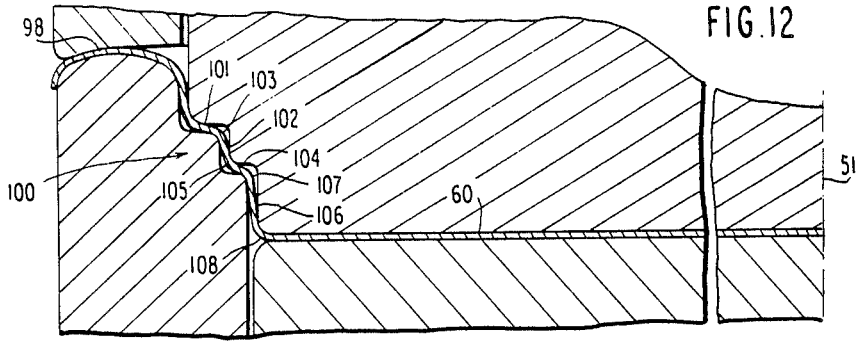
Figure 13:
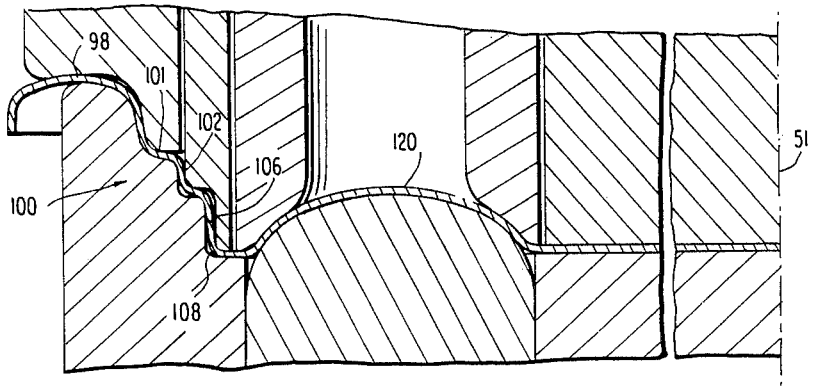
Figure 14:
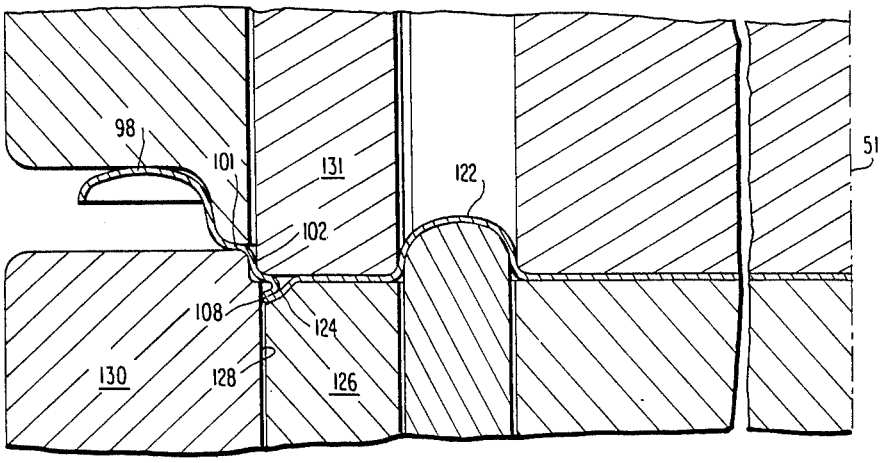
Figure 15:
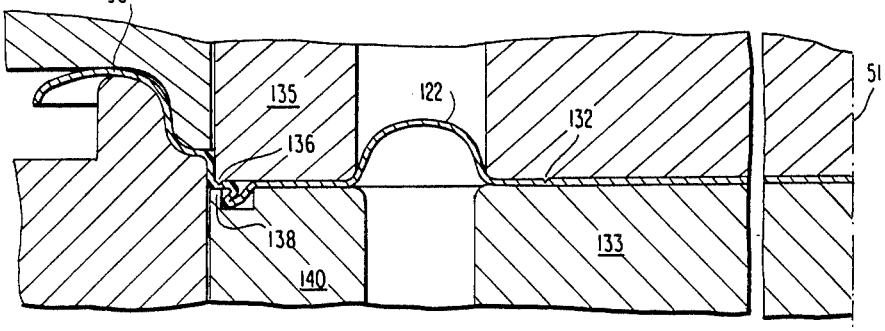
Figure 16:
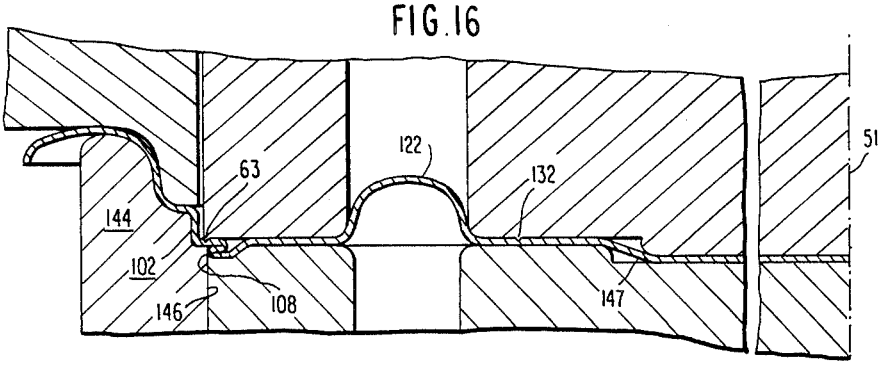
Figure 17:
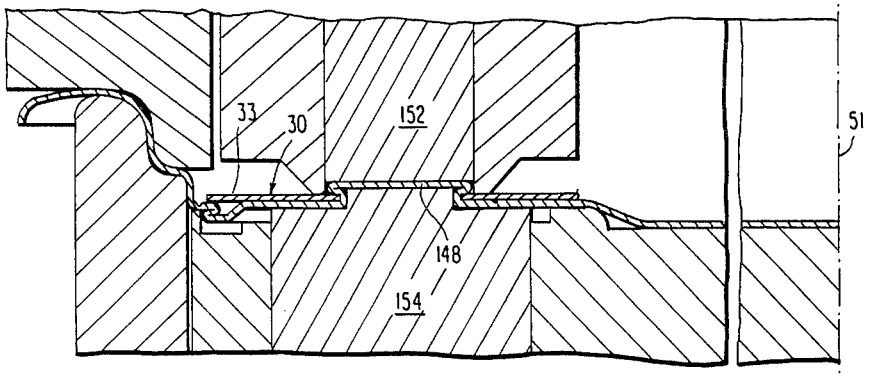

FIG. 8 shows further formation of the rivet button and initiation of prefolding of an inner multi-layer sheet metal fold, FIG. 9 shows scoring and initiation of prefolding of an outer multi-layer sheet metal fold, FIG. 10 shows completion of such multi-layer sheet metal folds, and FIG. 11 shows formation of a rivet securing an opener to the end wall panel while maintaining multi-layer sheet metal folds; and FIGS. 12–17 are radial cross sectional, partial views of tool and end closure structure for purposes of describing sequential fabrication of the embodiment of FIG. 5, in which:

FIG. 12 shows a blank forming stage,

FIG. 13 shows initial formation of a shallow-dome rivet button,

FIG. 14 shows further formation of such rivet button and prefolding of the multi-layer sheet metal fold (inner) which remains with the removable disc and initial formation of a barrier wall, FIG. 15 shows forming the peripheral scoreline, FIG. 16 shows completion of the barrier wall and folding of the inner multi-layer sheet metal fold, while a central panel profiling portion is impressed, FIG. 17 shows completion of the rivet securing an opener to the end wall, FIG. 18 is a plan view of an enclosure, without opener, for describing selection of chord length defined by the back scoreline means, FIG. 19 is a perspective view of an end closure being opened by a lever-action of the opener, with the handle end outboard of the rim of the container, for describing an interrelationship between the chord length, described in relation to FIG. 18, and lever action severance of the scoreline around at least about 180° of the removable disc periphery, and FIG. 20 is a perspective view of the end closure and container of FIG. 19 showing lift-out of the removable disc after lever-action severance of the peripheral scoreline.

The field of application of the present invention differs significantly from the present commercially-accepted disc-pull-out ends. In such prior art, edge safety features for a full-panel, easy-open can were not disclosed. Also, the peripheral scoreline, which defined the removable disc in such prior art, was positioned immediately adjacent to the chuck wall, that is, the portion of the end closure structure which forms the "backing" for the chime seam.

In any of the prior art disc "pull-out" ends, only a minor portion of the peripheral scoreline was ruptured by lever action. This took place initially and the remainder was separated by pulling backwardly on a ring-pull opener. In general, the removable disc folded over (or onto itself) such that the folding action enabled the residual metal along the remainder of the peripheral scoreline to be "torn", rather than being pulled apart under tension, as the opener was pulled in a direction opposite to the direction it was moved in for the initial rupture.

In certain prior "disc pull-out" end closures a vent opening scoreline was located in the removable disc, radially inwardly of the rivet used to secure the ring pull opener to the removable disc. In some of these, the back scoreline also included leg portions, one extending from each side of the vent portion of the back scoreline. The legs could be utilized to move the ring-pull opener from a radially-recessed position toward the peripheral scoreline at the chuck wall.

However, in the full-panel, convenience-feature safety-edge field of endeavor of interest herein, the peripheral scoreline (because of safety edge provisions for that portion of the end closure which remains with the container) is spaced radially inwardly from the chuck wall. Therefore, as taught herein, accurate placement and control of movement of the working end of the opener must be carried out to enable easy-opening.

Also, the removable disc cannot be folded back, or rolled back, upon itself as in container "disc pull-out"

prior art, because the safety edge provisions for the removable disc make the removable disc sufficiently rigid so that it remains substantially planar throughout the opening procedure for the container.

Figure 1:
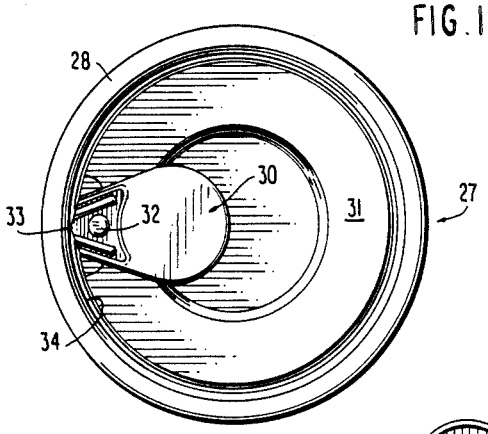
FIG. 1 is a plan view of the exterior (public side) of an end closure structure in accordance with the invention.

Referring to the accompanying drawings, end closure structure 27, shown in plan view of its outer (public side) surface in FIG. 1, is formed with chime seam metal 28 around its periphery. A longitudinally-rigid opener 30 is secured to removable disc 31 by rivet 32. The working end 33 of the elongated integral opener 30 is positioned in contiguous relationship to a portion of peripheral scoreline 34; the latter has a circular configuration in plan view and defines the removable disc 31 portion. The end wall panel itself extends, as better discernable from FIG. 2, radially beyond the peripheral scoreline 34 to chuck wall 36.

Figure 2:
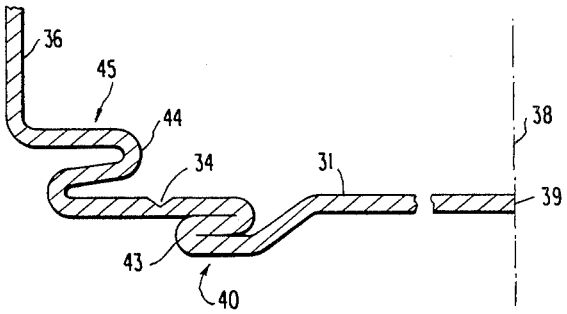
FIG. 2 is a radial cross sectional view of a portion of the end closure structure of FIG. 1.

FIG. 2 is a cross sectional view of a portion of FIG. 1. Peripheral scoreline 34 is spaced radially inwardly from chuck wall 36 toward the central longitudinal axis 36 for a container; such axis passes through the geometrical center 39 of end closure 27. In the embodiment of FIG. 2, a multi-layer fold of sheet metal on each radial side of scoreline 34 acts to shield the raw edge residual metal remaining after severing along peripheral scoreline 34. As shown, each multi-layer fold is a triple layer fold of sheet metal.

Triple layer metal fold 40 remains with the removable disc 31 upon and after severing along scoreline 34. Triple layer fold 42, radially exterior of the scoreline 34, remains with the end closure upon and after severing of scoreline 34.

Part of the teachings of the present invention relate to more accurate positioning of interacting portions of an end closure structure; and, placement of limitations on tooling for fabricating such end closures.

Figure 3:
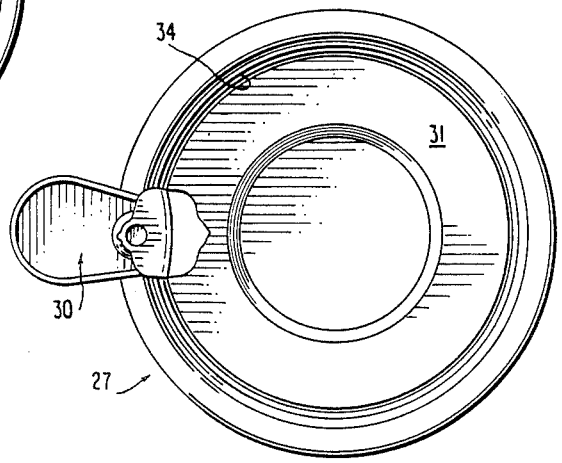
FIG. 3 is a plan view from the exterior (content side) of the end closure of FIG. 1 after initial opening procedures and prior to full panel removal.

Use of a back scoreline of the configuration partially shown in FIG. 1 (better seen in FIG. 3) would, ordinarily, tend to move integral opener 30 toward the chuck wall. The invention teaches control of such opener means to substantially prevent such radial movement of the opener; and, for directing the force of the working end of such opening toward initiating rupture of the peripheral scoreline, within prescribed limits.

For example, as taught herein, the center of peripheral scoreline 34 is positioned radially to be contiguous to the radial position of the rounded transition zone metal 43 (FIG. 2) of the multi-layer fold 40. Such positioning enables metal 43 to shield the raw-edge residual metal remaining with disc 31 by at least partially obstructing access to such raw edge metal. Also, as taught herein, such positioning is desired regardless of whether a multi-layer sheet metal fold (FIG. 2) or other means, shown in later figures, is used to protect the residual-metal raw-edge residual metal remaining with the end closure.

The peripheral scoreline 34 has a predetermined diameter (measured in the plane of the end wall) which approximates, but is less than, that of the shielding-means rounded-edge metal remaining with the end closure. For example in FIG. 2, the centerline (which is the apex of the "V" shaped cross sectional configuration) of peripheral scoreline 34 has a diameter which can be approximately equal to that of rounded edge metal 43 of the transition zone for multi-layer fold 40; but, must be less than that of rounded edge metal 44 of the outer multi-layer sheet metal fold 45; otherwise, edge 44 would block removal of a disc which had a larger diameter.

Thus, between such two limits there is a range for application of such initial rupture force which, to facilitate ease of opening, is measured in thousandths of an inch for a three-inch diameter can. This range takes into account an arcuate path movement for the working end of the opener and, the "V" shaped configuration, in cross section, of the peripheral scoreline. Controlling movement of the integral opener so as to guide its working end to contact the end wall panel within an acceptable range, as taught herein, is carried out by positioning barrier means to direct the working end of the opener inwardly toward such peripheral scoreline and recessed end wall panel.

Figure 4:
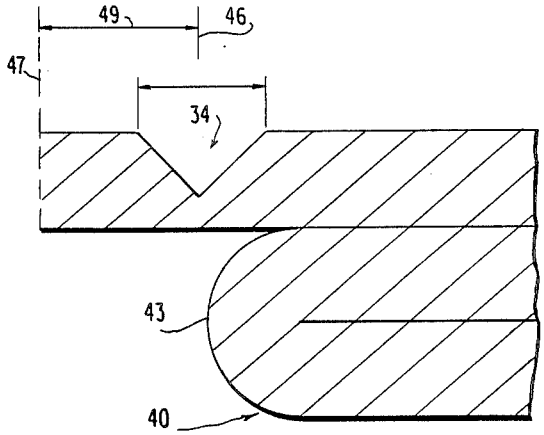
FIG. 4 is an enlarged radial cross section schematic view in the area of the peripheral scoreline for purposes of describing teachings of the invention of interrelated placement of portions of an end closure structure.

In the enlarged radial cross sectional view of FIG. 4, location 46 represents the circumferential projection (radial location) of the centerline of scoreline 34; such centerline has a diameter which approximates or is slightly greater than that of the transition zone metal 43 of multi-layer folds 40. The open end of the "V" shaped (in cross section) scoreline 34 extends between about five and about ten thousandths of an inch radially. For example; scoring 0.006" deep with a scoring tool having a 50° included angle results in the open end of the "V" having a radial dimension of 0.0056"; and, scoring 0.009" deep with a scoring tool having a 60° included angle results in an open end having a radial dimension of 0.0104". Interrupted line 47 represents the circumferential projection (radial location) of a barrier means, as taught herein, for turning the working end of a tab opener inwardly toward the recessed end wall panel by preventing radial movement of such working tip of the opener in the plane of, or parallel to the plane of, the end wall panel.

By eliminating such horizontal component of movement, the lever-action opening force is thus directed vertically downwardly and toward the scoreline. In accordance with present teachings, the radial distance 49 between rounded edge 43 (approximately the centerline 46) and the barrier location 47 can be in a range between about five and about twenty thousandths of an inch for an end wall closure structure for a three (300) to a three and seven sixteenths (307) inch diameter container in which the end wall made from flat rolled steel of about 0.008" to 0.010" nominal thickness gage. Within such range, by preventing radial movement of the opener, its working end will be turned, toward the end wall panel, into the open end of the peripheral scoreline; and, thereby facilitate ease of opening.

The diameter of the peripheral score centerline cannot be greater than the diameter for barrier 47 in accordance with present teachings. Ideally the peripheral score 34 has a diameter which locates its centerline 46 midway between the diameter of rounded edge 43 and that of barrier 47; and the distance from the centerline to each is about five thousandths. Positioning the barrier means 47 closer to the chuck wall, i.e., beyond the above designated range, will diminish the ease of opening, if not make opening impossible for an average consumer.

The barrier means referred to in describing FIG. 4 takes the form of the multi-layer fold 45, including rounded transition zone 44, in the embodiment of FIG. 2. However, in other full-panel, convenience-feature, safety-edge, end closure embodiments, in which a multi-layer sheet metal fold is used only on the removable disc, another type of barrier is provided as described below.

In the embodiment of FIG. 5, side wall 50 of a container, having a centerline axis 51, includes a necked-in, circumferentially-disposed detent 52. Such detent presents rounded-edge metal 54 for purposes of shielding raw-edge residual metal remaining with the end closure; and, rounded-edge metal 55 of the multi-layer sheet metal fold 56 for shielding raw-edge residual metal remaining with removable disc 58.

Detent 52 includes a shelf-like radially directed portion 60 leading to chuck wall 62. To carry out present teachings, and in accordance with methods of fabrication described more fully in relation to later figures, barrier wall 64 is positioned as shown, that is radially-inwardly of chuck wall 62 and preferably in parallel relationship to such chuck wall as viewed in cross section.

In practice of the invention with the two illustrated embodiments of both FIGS. 2 and 5, the centerline of the peripheral scoreline has a diameter approximately equal to or slightly greater than the diameter of the rounded-edge transition zone (43, 55) of the multi-layer sheet metal fold (40, 56) remaining with the removable disc (31, 60); and, such centerline diameter can approach but cannot exceed that of the diameter of the barrier means. In accordance with methods taught herein, the fabrication tooling is utilized to establish such prescribed limits so as to enable consistent production of end closures with the desired easy-open initial rupturing feature.

Figure 6:
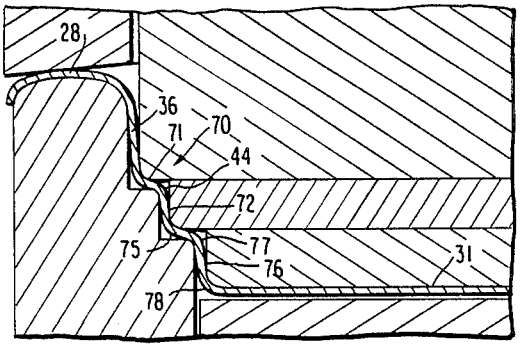

FIGS. 6 through 11 are radial, cross sectional, partial views for purposes of describing sequential stages in the formation of the double multi-layer sheet metal fold, end closure structure embodiment shown in FIG. 2. FIG. 6 shows a blank after "curling" of chime seam metal with the end wall panel countersunk in relation to chime metal 28. Viewed in radial cross section, from chuck wall 36 a series of "steps and risers" lead to the countersunk portion of the end wall panel 31. Such "steps and risers," generally designated 70, comprise part of the sheet metal portions utilized in forming (as described in greater detail in copending application Ser. No. PCT/US87/02649) a pair of multi-layer folds of sheet metal; one such fold for shielding residual raw edge metal remaining with the disc after separating along the peripherally located scoreline and, one for shielding residual raw edge metal on that portion of closure structure remaining with the container.

The step and riser portions of these multi-layer folds of sheet metal are joined to each other, and also joined at each end to the chuck wall and end wall panel respectively, by transition zones of compound curvature (i.e. curvilinear in a plane which is perpendicularly transverse to the central axis of the container and, also, curvilinear (rounded) in radial cross sectional view of such zone).

Figure 7:
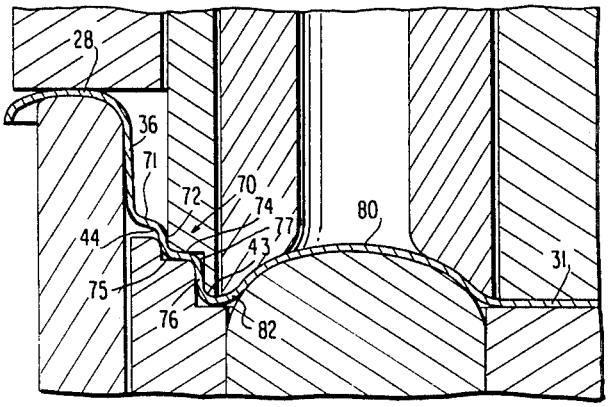

As shown in FIGS. 6, 7, step portion 71 leads to riser portion 72 through intermediate transition zone 44; step portion 74 is connected to riser portion 72 through curvilinear zone 75; step portion 74 leads to riser portion 76 through transition zone 77; and riser portion 76 leads to transition zone 43 leading to end wall panel 31.

In carrying out conversion-press procedures of FIGS. 7–11 in which the end wall is indexed for each step, the timing of the scoring action and the multi-layer folding action, and the extent to which multi-layer prefolding is carried out prior to formation of the peripheral scoreline 34, are important considerations along with establishing limits as described above for interrelated positioning of the barrier means, scoreline, and the inner multi-layer fold.

The peripheral scoreline for the removable disc is to be disposed intermediate to the pair of multi-layer folds, as described above. Each such respective multi-layer fold shields its respective residual scoreline metal edge remaining with the separated disc and with the container end structure. The procedure taught enables tooling access beyond the multi-layer pre-fold, on each surface of the end closure; thus, enabling scoring of a single thickness of sheet metal from one surface of the sheet metal while such single thickness is supported oppositely to the scoring tool on the remaining surface of the sheet metal by a "backing" tool.

The prefolding of the sheet metal layers provides for completing the folding action, around such circular periphery, while minimizing movement of multi-layer fold metal of the type which might cause premature damage to residual scoreline metal after scoring.

In the operation of FIG. 7 (which is sequential to FIG. 6) an initial rivet button configuration 80, having a broad-diameter, shallow-dome shape in cross section is formed. Also, the horizontal disposition of sheet metal "step" portion 74 is maintained as shown; peripheral scoring (34) will subsequently take place on such horizontally oriented metal portion 74.

Multi-layer folding of the sheet metal, scoreline formation, rivet button and profiling formation, and riveting a tab opener to the disc are coordinated while optimizing the number of steps in a conversion press. In addition to the above enumerated advantages of scoring a single layer of metal, avoiding premature damage to residual scoreline metal and establishing placement limits, the rivet button formation and riveting actions are carried out in sequence without interfering with the metal folding or scoring operations. Embossing opening instructions can be carried out simultaneously with formation of the rivet button and the central panel profile shown in FIG. 1.

As carried out in the sequences shown in FIGS. 8–10, metal portions 71, 72 and compound curvature zone 44 will form a multi-layer fold for shielding the raw edge metal remaining with the end closure structure on the container. Metal portion 74 will be the connector between the pair of multi-layer sheet metal folds; and, the scoring to form peripheral scoreline 34, which will define the removable panel 31, will be carried out on such metal portion 74. Metal portion 76 is joined to the horizontal intermediate portion 74 by compound curvature zone 77; compound curvature transition zone 43 and a portion 82 (of the end wall panel adjacent to zone 43) complete the multi-layer fold 40 for providing shielding for the residual raw edge metal remaining with the severed disc 31.

In FIG. 8, a smaller-diameter, greater-depth rivet button 83 is formed initially and the pre-folding of the metal portions 76, 82 about zone 43 takes place as shown. In FIG. 10, the limits on the radial placement of the transition zone rounded-edge metal portions (43, 44) in relation to peripheral scoreline 34, are established by the tooling shown as the sheet metal folds are completed. That is, tooling 84 limits the radial location of rounded edge 43; and, tooling 85 limits the radial location of rounded-edge 44.

In the final sequence of FIG. 11, the tab opener (30) is placed over rivet button 91 for the rivet forming step carried out between tooling 92, 94. In plan view the periphery of zone 44 is within the prescribed limits described above in relation to a projection of such centerline of scoreline 34 so as to at least partially shield the raw-edge of metal which will remain with the container from direct access when the peripheral scoreline is severed. The position of the multi-layer fold 42 (FIG. 2) limits radial-direction movement of opener 30 so that working end 33 is directed inwardly in relation to the container toward the peripheral scoreline 34.

The approximate dimensional values presented in the following tables are representative for a 307 (3 7/16") diameter can end structure:

| | |
|---|---|
| sheet metal | flat rolled steel |
| coating | tinplate or TFS with organic coating |
| nominal thickness | .008"–.010" |
| blank diameter | 4.225" |
| peripheral scoreline 34 centerline diameter | 3.1" |
| residual scoreline metal thickness | .002"–.0025" |
| length of chord 167 (FIG. 18) | about 1.0" to 1.1" |
| curvilinear zone 75 (FIG. 6) dia. | 3.18" |
| chuck wall 36 dia. (FIG. 6) | 3.25" |
| chuck wall height | .18" |

Axial dimension between center of chime seam metal and panel 31

| | |
|---|---|
| FIG. 6 | .39" |
| FIG. 11 | .21" |

The location of the rivet is pre-determined in relation to the peripheral scoreline, with the radial distance between the center of each being selected at about 0.315" for end closures/or cans in the 211 to 307 range. This radial distance is determined, as taught herein, by a number of factors, not the least of which is the radius of the first button formation for the rivet; for example, the radial distance between the center of the rivet and the centerline of the peripheral scoreline cannot be less than such button radius plus the radial distance required for an inner fold and/or clearance for scoring.

Typically the sharp-edge chisel point of the working end of the opener is located contiguous to the peripheral scoreline; but, in a manner that the (shielding means) barrier fold 45, remaining with the container, does not impede the arcuate movement for initial rupturing-action of the working end of the opener and does not impede the removal of the disc from the container.

Typical thicknesses for flat rolled aluminum end closures would be 0.009" to 0.012" with residual metal thickness for scored severing lines of about 0.004" to 0.005".

FIGS. 12 through 17 are radial, cross sectional, partial views for purposes of describing sequential stages in the formation of the end closure structure embodiment of FIG. 5 in which a single multi-layer fold of metal is used and a barrier wall is provided radially exterior of the peripheral scoreline 63 in order to direct movement of the working end of the opener inwardly for initial rupture of such peripheral scoreline.

FIG. 12 shows a blank, with "curled" chime seam metal 98, in which the end wall panel 60 is countersunk in relation to chime metal 98. Viewed in radial cross section, a series of "steps and risers" lead to the countersunk portion. Such steps and risers, generally designated 100, are part of the sheet metal portions for forming a barrier wall and a multi-layer fold of sheet metal.

The step and riser portions of sheet metal are joined to each other, and at each end leading, respectively, to the chime metal and end wall panel by metal transition zones of compound curvature, i.e. curvilinear in a plane which is perpendicularly transverse to the central axis of the container and, also, curvilinear (rounded) in a radial cross sectional plane.

Referring to FIG. 12, step portion 101 leads to riser portion 102 through intermediate transition zone 103; step portion 104 is connected to riser portion 102 through transition zone 105; step portion 104 leads to riser portion 106 through transition zone 107; and riser portion 106 leads to transition zone 108 formed with panel 60.

In carrying out the conversion press procedures of FIGS. 13–16, the timing of the sheet metal folding action, the scoring action, and the extent to which multi-layer prefolding and barrier wall formation is carried out prior to formation of the peripheral scoreline are important considerations.

The peripheral scoreline for the removable disc is to be disposed intermediate a multi-layer fold (for shielding residual raw-edge scoreline metal on the separated disc) and a barrier wall. The latter which is to be positioned radially inward of the end closure chuck wall and predeterminedly positioned in relation to the peripheral scoreline. As described earlier, the diameter of the peripheral scoreline 63 cannot exceed the diameter of such barrier wall.

The procedure taught enables tooling access, beyond the multi-layer pre-folded status of the shielding means to be located on the removable disc so as to enable scoring of a single thickness of sheet metal; the latter is supported oppositely to the scoring tool on the remaining surface. The prefolded status of the sheet metal layers provides for completing the folding action, around the circular periphery removable disc while minimizing movement of pre-folded metal, after such scoring, of a type would prematurely damage residual scoreline metal.

In the first conversion press operation of FIG. 13, an initial rivet button configuration 120 having a broad-diameter shallow-dome shape in cross section is formed; this establishes the indexing for subsequent steps. Rivet button 120 is formed while maintaining the established interrelationship of the steps and uprights with tooling as shown.

In the second conversion press operation of FIG. 14, a smaller-diameter, greater-depth rivet button 122 is formed, the pre-folding of the multi-layer sheet metal fold for the removable disc is carried out with riser portion 106 and a peripheral edge metal of panel 60 being prefolded in a recessed portion 124 of tool 126, with rounded edge 108 being positioned radially inwardly from its earlier position in FIG. 13. Rounded edge 108 is held to that location by side wall 128 of tool 130. Also, the positioning of barrier wall 102 is established by coaction between a portion of tool 130 and tooling 131.

In FIG. 15, the pre-folded relationship between sheet metal portions of FIG. 14 is held, as shown, while leaving access for backing support for scoring to form the peripheral scoreline in a single layer metal. The back scoreline 132 can also be carried out simultaneously with support for such scoring being provided by tooling 133.

A toroidal-configuration (in plan view), peripheral scoreline tool 135 includes scoring knife 136; the peripheral edge portion 138 (toroidal in plan view) of tool 140 provides backing for the peripheral scoreline formation without disturbing the prefolded metal. The configuration of the chime metal 98 and rivet button 122 are not changed. The peripherally located scoreline 63 is contiguous to barrier wall 102; back scoreline 132 is located radially inward of the rivet button 122.

The sheet metal layers which will remain on the severed disc, prefolded as shown in FIGS. 14, 15, are now folded as shown in FIG. 16, with scoreline 63 located intermediate barrier wall 102 and the rounded edge metal 108. The centerline of scoreline 63 has a diameter which approximates or is slightly greater than the diameter of rounded edge 108 but less than the diameter of the barrier means (wall 102) as described earlier in relation to FIGS. 4 and 5.

In FIG. 16, tooling 144 provides radial backing for the barrier wall 102; and, inner side wall 146 of tool 144 provides a radial stop to hold the diameter of rounded edge portion 108 to the desired diameter. A centrally located profiling portion 147 can also be formed during this stage.

As shown in FIG. 17, rivet button 122 is formed into rivet 148, securing opener 150 to the end wall, using tooling 152, 154. Other portions of the end closure structure are supported as shown. Embossing of opening instructions, if desired, can also be carried out.

In an end closure for a 300 (3 inch diameter) container, flat rolled steel of 75#/bb (nominal 0.008" gage) which has been metal plated and organically coated is typically used; the following diameter measurements are representative:

| | |
|---|---|
| Scoreline (63) | 2.712" |
| Barrier wall (102) (inner surface diameter) | 2.722" |
| Barrier wall (102) (exterior surface diameter) | 2.740" |
| Chuck wall (62) | 2.854" |
| Chime metal (98) (center) | 3.040" |
| Centerline of button (122) | 2.086" |

Other representative dimensions include:

| | |
|---|---|
| Cross section diameter of rivet 150 head | .230" |
| Height of center of chime metal 98 above recessed end wall panel (FIG. 17) | .169" |
| Diameter of central profiling panel (147) | 1.5" |
| Depth of recessed profiling panel (147) | .03" |
| Residual scoreline metal thickness | .002"-.0025" |

Typical thicknesses for flat rolled aluminum end closures would be 0.009" to 0.012" with residual metal thickness for scored severing lines of about 0.004" to 0.005".

Another significant contribution of this invention relates to discovery of an interrelationship between the length of the chord formed between the intersection of each back score line leg and the multi-layer fold of sheet metal which remains with the removable disc.

In the plan view of an enclosure, without the opener, of FIG. 18, the back scoreline central portion 160 with a leg portion 161, 162 extending transverse to the radius from each side of the central portion. Such back score line legs then turn to a substantially radial direction (163, 164) and intersect with the inner multi-layer fold of sheet metal at 165, 166. Chord 167 is measured between such two points of intersection.

FIG. 19 shows the achievement of the desired affect of the lever-action opening in which the handle and the opener are acting outboard of the cylindrical periphery of the container, about the chime seam 170 as a fulcrum. The lifting action through intersection point 165, 166 causes severance about at least 180° of the periphery of removable disc 172. Thereafter, as shown in the perspective view of FIG. 20, the removable disc 172 can be readily lifted from the remains and closure structure by lifting an opener 174.

The length of chord 167 can be selected. The back scoreline embodiment of FIG. 3, with a chord length of about 0.75" is adequate to provide the desired lever-action severance of the peripheral scoreline around at least about 180° of the removable disc of an end closure for size 300 can. Whereas, a chord 167 length of about 1" to 1.1" is utilized with a 307 end closure to achieve at least about 180° of severance around such periphery. Such a chord length could also be used on a 300 end closure to more readily achieve the desired 180° of lever-action severance; but, a chord of 0.75" length would not facilitate readily achieving 180° of lever-action severance on a larger diameter can even though the lever mechanical advantage with the 0.75" chord is greater than that available with a 1" to 1.1" chord.

Specific materials, dimensions and configurations for various parts have been set forth for purposes of describing the invention; however, in the light of such teachings other such values could be ascertained by those skilled in the art; therefore, for purposes of determining the scope of the present invention references should be had to the appended claims.

I claim:

1. Full-open, safety-edge, disc-removal, convenience-feature sheet metal end-closure structure, comprising a generally-planar, circular-periphery end wall panel circumscribed by unitary chime seam meal for attaching such end wall closure structure to a container having a generally cylindrical-configuration side wall which is substantially symmetrical with the central longitudinal axis for such cylindrical configuration, such central longitudinal axis intersecting the end closure structure at its center when such end closure structure is attached to such container, such end wall panel being recessed axially in relation to such chime seam metal toward the interior for such a container, a cylindrical-configuration chuck wall which is substantially equidistant radially from such panel center and extending in an axial direction from such chime seam metal toward such axially-recessed end wall panel, a peripheral scoreline located contiguous to the periphery of such end wall panel, such peripheral scoreline being spaced radially inwardly from such chuck wall toward such panel center, such peripheral scoreline defining a removable disc to provide an opening in such end closure structure which facilitates full removal of container contents, a multi-layer fold of such sheet located on the interior surface of such end wall panel in relation to such a container and circumscribing such removable disc contiguous to such peripheral scoreline so as to be in position to shield raw edge residual metal of such scoreline upon rupture thereof, an elongated, longitudinally-rigid opener secured by a unitary rivet to such removable disc with the longitudinal axis of such elongated opener being oriented diametrically of such end wall panel, such elongated opener having a working end and a handle end at its longitudinally opposite ends, with such working end being disposed contiguously to a portion of such peripheral scoreline for purposes of initiating rupture thereof, back scoreline means positioned in such removable disc, such back scoreline means including a central portion partially circumscribing such rivet and located generally radially inwardly of such rivet toward such panel center, a leg extending from such central portion as it partially circumscribes such rivet, with one such leg on each side of such rivet having a major directional component which is effectively radial toward such adjacent portion of such peripheral scoreline to be initially ruptured by such working end of such opener, such legs terminating prior to contact with such peripheral scoreline at a location for each leg which is contiguous to such multi-layer fold of sheet metal circumscribing such removable disc, such central portion of the back scoreline means being ruptured by Class II lever action upon initial movement, about such unitary rivet as a fulcrum, of the handle end of the opener, such handle end moving in a direction away from the end wall panel in an arcuate path extending externally of such container, with continuous movement of such handle end of the tab opener in such arcuate path causing rupture along such back scoreline legs which would tend to cause movement of such opener in a radial direction toward such chuck wall and movement of the effective fulcrum axis for purposes of lever-action application of force by such opener, and barrier means located contiguous to such peripheral scoreline and radially interior of such chuck wall, such barrier means being disposed to act along the exterior surface of such end wall panel to control radially-directed movement of such opener so as to establish a radial location for directing movement of such working end toward such recessed end wall panel to initiate rupture of such peripheral scoreline.

2. The structure of claim 1 in which such directed movement of the working end of such opener toward such end wall panel ruptures a minor portion of the peripheral scoreline contiguous to contact of such working end of the opener with such end wall panel, such minor portion of the peripheral scoreline being ruptured by Class I lever action of such opener at least in part about such effective fulcrum axis established by such barrier means in controlling radially-directed movement of such opener.

3. The structure of claim 2 in which such peripheral scoreline presents a substantially circular configuration in plan view, and such multi-layer fold of sheet metal is of substantially circular configuration in plan view and is in contiguous relationship to such peripheral scoreline, such multi-layer fold presenting a rounded-edge transition zone between such sheet metal layers having a circumference approximating that of such peripheral scoreline so as to be in shielding relationship to raw edge material of such peripheral scoreline, after severance thereof, by obstructing direct access to such raw edge residual peripheral scoreline metal.

4. The structure of claim 3 in which rupture of the remainder of such peripheral located scoreline beyond such minor portion is carried out after continued arcuate direction movement of the handle end of such opener through an arc in excess of about ninety degrees which brings about contact of such opener with such chime seam metal, and, in which such chime seam metal contact acts as a fulcrum for additional lever-action severance of the peripheral scoreline, such additional lever-action severance, provided by such continued arcuate direction movement of such handle end of such opener, comprising Class I lever action which moves such removable disc in a direction externally away from such a container causing continued rupture of such peripheral scoreline beyond such initially ruptured portion.

5. The structure of claim 4 in which such barrier means comprises a multi-layer fold of such end wall sheet metal located radially-outboard of and contiguous to such circular configuration peripheral scoreline, such barrier-means multi-layer fold of sheet metal, providing shielding means for raw-edge residual scoreline metal remaining with such end wall structure after rupture of such peripheral scoreline, being disposed on the exterior surface of such end wall panel in relation to such a container and presenting, in a plan view of such end wall structure, a substantially circular configuration with a rounded-edge transition-zone portion having a preselected minimum circumference in relation to the circumference of such peripheral scoreline, such barrier-means multi-layer fold of sheet metal protruding radially inwardly from such chuck wall of the end wall structure so as to obstruct radially-directed movement of such opener toward such chuck wall and direct the working end of such opener toward such recessed panel and such peripheral scoreline for initiating rupture thereof.

6. The structure of claim 4 in which such a container includes a cylindrical-configuration side wall presenting a necked-in detent about the circumference at its open end contiguous to such wall, such detent being directed radially toward such central longitudinal axis and presenting a curvilinear surface for shielding raw-edge residual scoreline metal of such peripheral scoreline which remains with such container by at least partially obstructing access to such raw-edge residual metal after removal of such disc, and such barrier means comprises a barrier wall of substantially cylindrical configuration which is substantially symmetrically disposed with relation to such central longitudinal axis and is located radially inward of such chuck wall so as to obstruct radial movement of such working end of the elongated opener and direct such working end toward such recessed end wall panel and such peripheral scoreline for initiating rupture thereof.

7. The structure of claim 4 in which the distance measured along a chord extending between the intersection of each back scoreline leg with such inner multi-layer fold of sheet metal, remaining with this removable disc, is selected so that such additional lever-action severance provided by such opener about the chime seam as a fulcrum results in the peripheral scoreline being ruptured through at least about 180° of such removable disc periphery.

* * * * *